US007181033B2

(12) United States Patent
Fischer et al.

(10) Patent No.: US 7,181,033 B2
(45) Date of Patent: Feb. 20, 2007

(54) METHOD FOR THE OPERATION OF A HEARING AID AS WELL AS A HEARING AID

(75) Inventors: Eghart Fischer, Schwabach (DE); Volkmar Hamacher, Wuerselen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 342 days.

(21) Appl. No.: 10/273,066

(22) Filed: Oct. 17, 2002

(65) Prior Publication Data

US 2003/0072465 A1 Apr. 17, 2003

(30) Foreign Application Priority Data

Oct. 17, 2001 (DE) ..... 101 50 675

(51) Int. Cl.
*H04R 25/00* (2006.01)

(52) U.S. Cl. ..... 381/317; 381/312; 381/313

(58) Field of Classification Search ..... 381/81, 381/85, 94.5, 107, 109, 93, 94.1, 381, 104, 381/108, 119, 91, 92, 94.2, 312, 313, 314, 381/317, 320, 321, 331, 355–358, 122
See application file for complete search history.

(56) References Cited

U.S. PATENT DOCUMENTS 3,814,856 A * 6/1974 Dugan ..... 381/57
4,425,481 A 1/1984 Mansgold et al.
5,524,056 A * 6/1996 Killion et al. ..... 381/314
6,101,258 A 8/2000 Killion et al.
6,394,947 B1 5/2002 Leysieffer

FOREIGN PATENT DOCUMENTS

DE 195 34 981 3/1997
DE 195 42 961 5/1997
DE 198 59 171 11/2000

* cited by examiner

*Primary Examiner*—Huyen Le
(74) *Attorney, Agent, or Firm*—Schiff Hardin LLP

(57) ABSTRACT

A hearing aid is provided that avoids disturbing acoustic effects caused by on, off, or switchover events. The signal processing in the hearing aid is switched in sliding fashion from a first operating condition into a second operating condition. According to the invention, both operating conditions are simultaneously present in the hearing aid during the switching event. The sliding transition ensues by a parallel signal processing in at least two signal paths of the hearing aid, whereby a signal that results from the first operating condition and a signal that results from the second operating condition are added in changing weighting.

34 Claims, 6 Drawing Sheets

METHOD FOR THE OPERATION OF A HEARING AID AS WELL AS A HEARING AID

BACKGROUND OF THE INVENTION

1. Field of the Invention

The invention is directed to a method for operating a hearing aid having: 1) an input transducer for picking up an input signal and converting it into an electrical signal, 2) a signal processing unit for processing and amplifying the electrical signal, and 3) an output transducer. The invention is also directed to a hearing aid for implementing the method.

2. Description of the Related Art

A plurality of hearing programs can be set in a known hearing aid for an optimized operation in different auditory situations. Switching between the individual hearing programs can be manual or automatic. For example, such a hearing aid is disclosed by U.S. Pat. No. 4,425,481.

The Prior Art also discloses hearing aids in which algorithms for signal processing in the hearing aid can be switched on and off for further adaptation to different auditory situations. These algorithms relate, for example, to the compression, the reduction of noise signals, or the boosting of speech signals.

Both the switching between various hearing programs as well as the activation of algorithms in the hearing aid can ensue manually or automatically. This usually produces disturbing acoustic effects and irritations in the perception of sound signals in associated natural auditory situations. These effects are usually expressed in the form of disturbing popping noises, unnatural level discontinuities or unnatural, sudden changes in timbre.

German Patent Document DE 195 42 961 C1 discloses a circuit for operating a hearing aid equipped with at least one variable operating parameter as well as a hearing aid itself, in which the operating parameter settings of an initial situation as well as of a target situation are defined in a memory arrangement, and a control unit can switch the operating parameter from the initial situation setting into the target situation setting over a certain time interval.

German Patent Document DE 195 34 981 A1 discloses a method for fine adaptation of hearing aids in which an evaluation step firstly evaluates the degree of optimization of parameters set at the hearing aid (e.g., using psychoacoustic properties) and then in a following optimization step adjusts parameters in need of improvement. The degree of optimization to be evaluated or quantities that are responsible for this are determined in the framework of the evaluation step and/or the degree of adjustment of the parameter in need of improvement that is the determining factor in the optimization step is determined by algorithms or, respectively, rule sets based on fuzzy logic.

German Patent Document DE 198 59 171 C2 discloses an implantable hearing aid with a tinnitus masker or noiser in which has a digital signal processor that is designed both for editing the audio signal as well as for generating the signals needed for the tinnitus masking or noiser function and for merging the latter signals with the audio signal.

SUMMARY OF THE INVENTION

An object of the present invention is to avoid disturbing acoustic effects in a hearing aid that are produced by turn-on, turn-off or switching events.

A method is provided for operating a hearing aid having: 1) an input transducer for picking up an input signal and its conversion into an electrical signal, 2) a signal processing unit for processing and amplifying the electrical signal, and 3) an output transducer, in which a switching event is triggered for switching the hearing aid from a first operating condition into a second operating condition and in which a sliding transition ensues from the first operating condition to the second operating condition. The inventive object is achieved in that both operating conditions are present in parallel in the hearing aid during the switching event, where a parallel signal processing ensues at least in that part of a signal path in which the two operating conditions differ, where a first signal that results from the first operating condition and a second signal that results from the second operating condition are operated with one another via a weighting function, and where the weighting of the first signal decreases and the weighting of the second signal increases during the switching event.

This object is also achieved in a hearing aid for implementing the method in that both operating conditions are present in parallel in the hearing aid during the switching event, and the hearing aid comprises an ability for a weighted operation of a signal that results from the first operating condition with a signal that results from the second operating condition.

The inventive hearing aid that implements the inventive method is, for example, a hearing aid worn behind the ear, a hearing aid worn in the ear, an implantable hearing aid, or a pocket hearing aid. Furthermore, the hearing aid that is employed can also be part of a hearing aid system comprising a plurality of devices supplied to a hearing-impaired person, for example, part of a hearing aid system having two hearing aids worn at the head for binaural supply or part of a hearing aid system composed of a device worn at the head and a processor unit worn on the body.

The hearing aid comprises an input transducer for picking up an input signal. Normally, a microphone serves as an input transducer, this picking up an acoustic signal and converting it into an electrical signal. However, an input transducer may also utilize units that comprise a coil or an antenna and that pick up an electromagnetic signal and convert it into an electrical signal.

The hearing aid also comprises a signal processing unit for processing and frequency-dependent amplification of the electrical signal. A digital signal processor (DSP) whose functioning can be influenced by programs or parameters that can be transmitted onto the hearing aid preferably serves for signal processing in the hearing aid. As a result, the functioning of the signal processing unit can be adapted to the individual hearing loss of the hearing aid user as well as to the current auditory situation in which the hearing aid is being operated at the moment.

The electrical signal modified in this way is finally supplied to an output transducer. This is usually fashioned as an earphone that converts the electrical signal into an acoustic signal. However, other embodiments are also possible here, for example, an implantable output transducer that is directly connected to an ossicle and causes this to oscillate.

As explained above, the signal processing in the hearing aid can be controlled by parameters. An entire set of parameters that serves for setting the signal processing to a specific auditory situation is referred to as a "hearing program". Given a change of the hearing program, a plurality of parameters is usually changed. In addition to the parameters for controlling the signal processing, however, specific algorithms can also influence the signal processing in the hearing aid. For example, an automatic gain control (AGC) can be effected by an algorithm. Another algorithm can serve for recognizing and reducing noise signals. A specific boost of voice signals is also possible using an expedient algorithm.

In addition to parameters for controlling the signal processing in the hearing aid and the algorithms that themselves effect a signal processing and thereby influence the signal processing in the hearing aid, hearing aids offer additional functions that can be activated, deactivated or set. One such function that can be carried out with the hearing aid can, for example, relate to the microphone system. In a hearing aid, an omnidirectional or a directional reception can be set, and, given an directional reception, the degree of the directional effect of the microphone system can be defined. Further functions relate, for example, to a signal that can be added in for tinnitus therapy or the reception of an input signal by a telephone coil.

Modern hearing aids, thus, offer a multitude of setting possibilities with which they can be adapted to different auditory situations or individual wishes and needs of a hearing aid user. When the auditory situation changes during the operation of the hearing aid or when the hearing aid user wishes a change in a function of the hearing aid, then a switching event is required. A "switching event" is switching an algorithm on or off, activating or deactivating a function, or the discontinuous change of at least one parameter of the signal processing. For example, a continuous change of the gain by a volume control is thus not a switching event in the sense of the invention.

Up to now, hearing aids have been suddenly switched from a first operating condition into a second operating condition by the switching event. Compared to the first operating condition, an algorithm is turned on or off in the second operating condition or the algorithm is modified in terms of its function. Likewise, a function of the hearing aid can be activated, deactivated or modified by the switching. The sudden change of the operating condition is accompanied by disturbing acoustic effects and irritations in the perception of sound signals connected with this. Such effects are avoided by the sliding transition from the first operating condition to the second operating condition according to the invention.

The trigger for the change of the operating condition continues to be the activation or deactivation of an algorithm or of a function or, a modification of an algorithm or of a function. According to the invention, however, the changes that have ensued do not take effect immediately and in their full scope on the signal output via the output transducer. The clicking or popping noises arising in traditional hearing aids, unnatural level discontinuities as well as unnatural changes in timbre are thus suppressed. The change of the operating condition ensues by a sliding transition from the first operating conditions to the second operating condition.

The method of the invention can be applied when an algorithm is switched on or off as well as when an activated algorithm is modified. In the latter case, the algorithm executes a first function in the first operating condition and executes a second function in the second operating condition. Given, for example, an algorithm for automatic gain control, this can mean a modification of the compression characteristic. However, algorithms that affect the frequency response, the reduction of noise signals, the boost of voice signal, or the directional characteristic can likewise be switched on, switched off, or be modified in terms of their function.

As well as being applied to algorithms that execute a signal processing, the invention can also be applied to functions of the hearing aid that do not have an algorithm. For example, such an function can relate to the microphone characteristic. Possible functions of a microphone system are omnidirectional reception, directional reception, directional reception of the second order, etc.

In a hearing aid, the generation of a signal for tinnitus therapy can also be provided, for example. When this function is activated, then a signal for masking the tinnitus is output into the auditory canal in addition to the signal transmitted by the hearing aid. Another example of a function that can be put in or out is the reception of an electromagnetic signal by the telephone coil.

Given a switching event of the hearing aid from a first operating condition into a second operating condition, the invention provides that both operating conditions are temporarily present in parallel in the hearing aid. When, for example, an algorithm is switched on given the change of the operating condition, then this means that the signal processing during the switching event ensues both with the activated algorithm as well as with the deactivated algorithm, in parallel. The results of the parallel signal processing are finally weighted and merged. Advantageously, a parallel signal processing does not ensue over the complete signal path of the hearing aid but only in that part of the signal path of the hearing aid in which the two operating conditions differ. A preceding and a following signal processing can therefore likewise ensue for both operating conditions.

According to one embodiment of the invention, the sliding transition from the first operating condition to the second operating condition is achieved in that the two operating conditions are operated with one another via a weighting function in which the weight of a first signal that results from the first operating condition decreases gradually, steadily, or at most in small skips—beginning at 1—during the switching event, and the weight of a second signal that results from the second operating condition increases gradually, steadily or at most in small skips, beginning from 1. The sum of the these weights always preferably amounts at least approximately to 1.

When, for example, an algorithm for unwanted noise suppression is switched on, then this means that the signal processing initially continues to ensue without this algorithm in a signal path of the hearing aid. Parallel to this, the signal processing in a second signal path of the hearing aid ensues with the algorithm for unwanted noise suppression. The two signal paths are operated with one another via a weighting function immediately following the algorithm for unwanted noise suppression and at the corresponding location in the parallel signal path of the hearing aid. Beginning at 0, the weight of the algorithm for unwanted noise suppression is increased up to 1, and the weight of the corresponding, parallel processing without the corresponding algorithm is lowered beginning from 1. The sum of the weights is preferably always equal to 1. The hearing aid is thus switched from a first operating condition into the second operating condition automatically, "soft" and nearly unnoticed. Clicking or popping noises, unnatural level discontinuities as well as unnatural changes in timbre are thereby avoided.

One embodiment of the invention is characterized in that at least one parameter for the control of the signal processing in the hearing comprises a specific value in the first operating condition and comprises a value in a second operating condition that is discontinuously modified compared to the first value. As a rule, however, a plurality of parameters are simultaneously discontinuously modified given a switching event in the hearing aid, for example, given a change of the hearing program.

According to the invention, the switching event also does not immediately take full effect; rather, a sliding transition from the first operating condition to the second operating condition ensues. To this end, a parallel signal processing, first with the parameter in its initial value and then with the parameter in its final value, thereby ensues at least in the sub-region of the signal processing unit of the hearing aid that is influenced by the parameter. The outputs of the parallel signal processing blocks are then added with automatically changing weighting until only the signal branch with the parameter in its final value is in fact still active at the end of the transition. The invention is thereby distinguished from manually implemented setting events at the hearing aid that ensue continuously or quasi continuously given a digital hearing aid. Such settings relate, for example, to the volume control or settings with respect to the timbre. These can be set with operating elements; this setting, however, is not to be understood as a "switching event" in the sense of the invention.

The switching event is preferably controlled by a switching algorithm that is specifically intended for it. This determines the weighting of the two signals and, potentially, the location in the signal path of the hearing aid at which the two parallel paths are merged, so that the parallel signal processing remains limited to only one part of the signal path insofar as possible.

It is of no consequence in the invention whether the switching event is triggered manually, for example by actuating an operating element, or automatically, for example by an automatic situation recognition and switching of the hearing program.

One embodiment of the invention provides that the duration of the switching event can be set. Depending on how disturbing a user considers the switching events, the switching event can then be set "harder" or "softer". As a rule, the duration of the switching event will be selected in the range of a few seconds.

DESCRIPTION OF THE DRAWINGS

Further details of the invention are described below on the basis of exemplary embodiments and the drawings, in which.

DETAILED DESCRIPTION OF THE INVENTION

Figure 1:
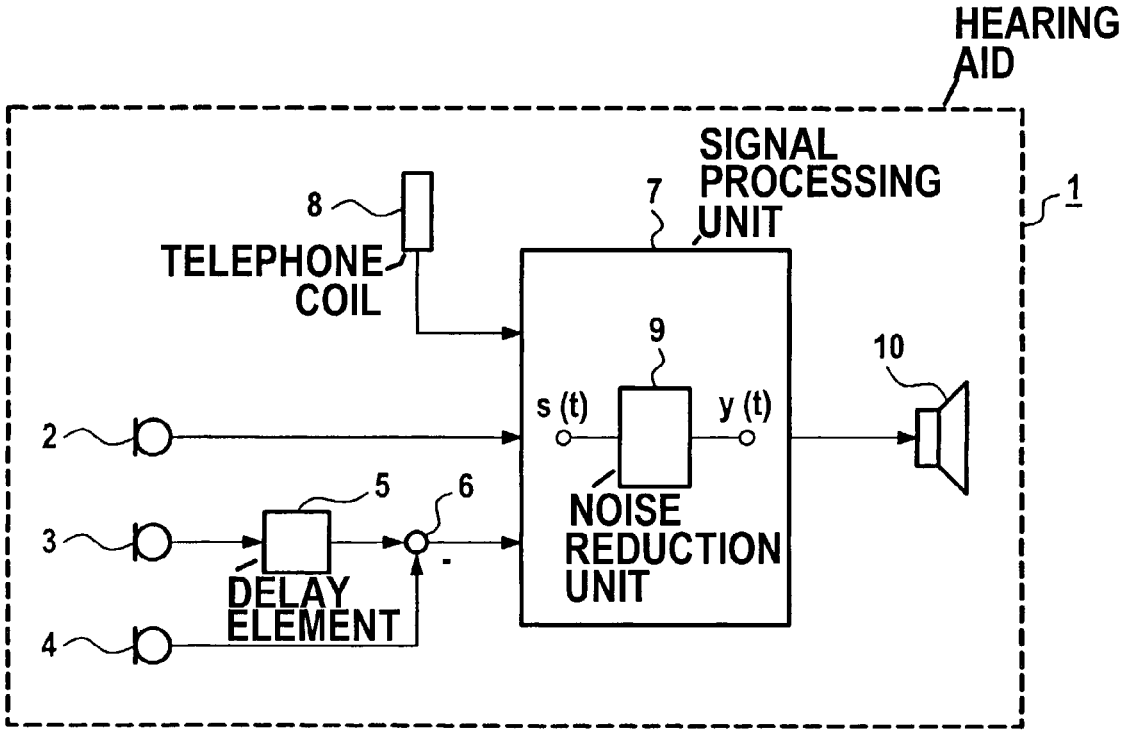
FIG. 1 is a block circuit diagram of a hearing aid in which an algorithm for signal processing as well as various functions can be set.

FIG. 1 shows a block circuit diagram of a hearing aid 1 in which an omnidirectional microphone 2 as well as a directional microphone formed of the microphones 3 and 4 are provided for picking up an acoustic input signal. For forming a directional microphone system, the two microphones 3 and 4 are electrically interconnected to one another via a delay element 5 as well as a difference element 6. The microphone signals are supplied to a signal processing unit 7 for further processing. This unit 7 preferably comprises a digital signal processor in which the signal processing ensues in parallel in a plurality of frequency channels. For compensating the individual hearing loss of a hearing aid user, the signal processing unit 7 can be set by a plurality or parameters. All of the processing functions of the hearing aid can be construed as the signal processing system of the hearing aid, including those functions that are described as occurring in the signal processing unit. In other words, the term signal processing system used to generically describe elements that perform the signal processing functions of the hearing aid.

Furthermore, a plurality of different parameter sets for adapting the signal processing in the hearing aid 1 to different auditory situations, what are referred to as "hearing programs", can also be offered and activated therein. Over and above this, the signal processing unit 7 allows the activation and setting of various algorithms for the signal processing or for functions of the hearing aid 1. Such algorithms can relate, for example, to the frequency response, the reduction of noise signals, the boosting of voice signals, the directional microphone characteristic, the compression, etc. Functions that can be set at the hearing aid 1 are, for example, the selection of the signal input via a telephone coil 8, via the microphone 2 or via the microphone system 3, 4. A further example of an adjustable function is the generation of a signal for tinnitus therapy.

The activation or setting of the algorithms or functions in the hearing aid 1 can ensue manually or automatically. For example, the hearing aid 1 can automatically recognize certain auditory situations, for example the auditory situation "environment with unwanted noise", and subsequently activate a corresponding hearing-program. Simultaneously with the appertaining hearing program, an algorithm for unwanted noise suppression is then also activated.

In the exemplary embodiment, this is illustrated by the circuit unit 9 for reducing noise signals within the signal processing unit 7. An input signal s(t) enters into the circuit unit 9, and an output signal y(t) is supplied at the output. Both s(t) as well as y(t) can be construed as vectors, i.e. a plurality of signals. Overall, a signal is taken at at least one location in the signal path of the hearing aid 1, is supplied to the circuit unit for reducing noise signals 9 and is in turn output back into the signal path after a signal processing. For example, a filtering can ensue in the circuit unit 9.

When an input signal has passed through the signal processing unit 7 of the hearing aid 1, then it is ultimately converted into a acoustic signal via an earphone 10 and supplied to the auditory canal of the hearing aid user.

An exemplary embodiment of the invention is described in greater detail below on the basis of the circuit unit 9 for reducing noise signals according to FIG. 1. To this end, the circuit unit 9 is schematically shown in a block circuit diagram in FIG. 2. An input signal s(t) is supplied to the circuit unit 9 at a signal input. An analysis unit 11A analyzes the input signal s(t) and recognizes whether it contains a noise signal. A binary signal a(t) is supplied as an output signal of the analysis unit 11A. The value 0 denotes that no noise signal was detected; the value 1 is generated when a noise signal is detected. The signal a(t) does not directly switch an algorithm for unwanted noise suppression on or off in the arithmetic unit 12 but initially is present at an input of a low-pass 11B. When the value of the signal a(t) jumps from 0 to 1, then the value of the signal k(t) at the output of the low-pass 11B rises steadily from 0 to 1 dependent on the time constant of the low-pass 11B. Together with the low-pass 11B, the analysis unit 11A thus forms a classifier 11 that does not switch "hard" between 0 or 1—i.e., "no noise signal present" or "noise signal present"—but rather creates a "soft", sliding transition.

The signal k(t) is directly adjacent to an input 13A and the value 1-k(t) formed in an arithmetic unit 14 is adjacent at an input of a multiplier 13B. As can also be seen from the block circuit diagram, the input signal s(t) is directly supplied to the multiplier 13B, whereas the signal passes through the arithmetic unit 12 first before it is supplied to the multiplier 13A. Finally, the two parallel signal paths are brought back together by a summer 15. The arithmetic operations implemented by the arithmetic unit 12 thus do not initially take full effect on the output signal y(t) given a jump of a(t) from 0 to 1 but only to the extent to which the signal k(t) rises. The effect of the signal s(t) originally directly through-connected onto the output y(t) is reduced to the same extent. After a specific, preferably adjustable time duration, the value of the signal k(t) has increased to 1, at which time the arithmetic unit 12 develops its full effect at the signal output y(t), and the direct signal path is deactivated, bypassing the arithmetic unit 12.

When the analysis unit 11A no longer detects any noise signals in the input signal s(t), then the signal a(t) switches from 1 to 0 and the reverse process is set in motion.

The "soft" on and off switching of an algorithm was described in the exemplary embodiment on the basis of a circuit unit for reducing noise signals. Analogously, however, this procedure can be transferred to any arbitrary algorithm that executes a signal processing in the hearing aid. In addition to switching algorithms on and off, a switch can also be made between different algorithms. Over and above this, it is also possible that the calculating rule that is carried out by an algorithm should change as a result of the switching. In this case, both the original algorithm as well as the altered algorithm are then inventively implemented during the switching event. Differing from the illustrated exemplary embodiment according to FIG. 2, arithmetic units for the parallel implementation of these algorithms are then located in the two signal paths between the signal input s(t) and the summer 15, the results being then added with changing weighting according to the invention.

The invention offers the advantage that unwanted noises or unnatural changes in sound caused by on, off or switchover events are avoided in the hearing aid of the invention. This effect is particularly advantageous given switching events in the hearing aid that are automatically triggered. Under certain external conditions, namely, a great number of switching events occur within a short time, for example within a few seconds. This can be the case in the exemplary embodiment when only a weak noise signal is present. The output signal a(t) of the analysis unit 11A then changes very frequently between 1 and 0, i.e., "noise signal present" or "no noise signal present". In combination with the low-pass 11B, the multipliers 13A and 13B as well as the arithmetic unit 14, this then leads to a condition that both operating conditions are in effect in parallel in the hearing aid over a longer time span since the output signal k(t) of the classifier 11 reaches neither of the limit values 0 or 1. In the exemplary embodiment, the unwanted noise reduction would be only partly effective. For the initial situation of a weak noise signal that has been assumed by way of example, however, this is definitely desirable and meaningful.

Figure 2:
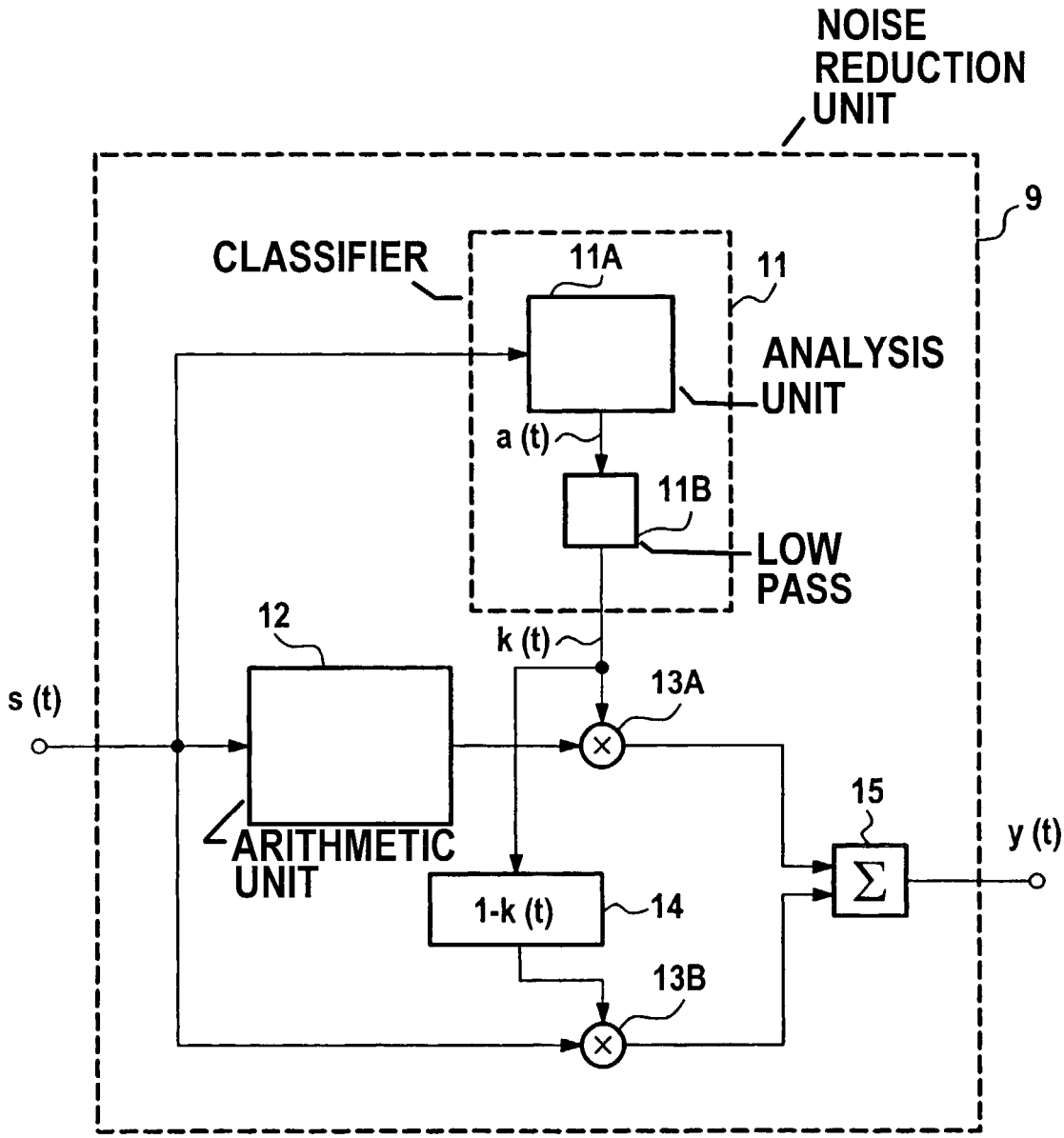
FIG. 2 is a block circuit diagram of a first circuit unit for sliding activation and deactivation of an algorithm.

The exemplary embodiment according to FIG. 2 shows only one possible embodiment of a weighting function with automatically changing weighting. Here, too, alternative solutions are also possible. Furthermore, this is only a schematic block circuit diagram. In the practical realization, further circuit elements that are not shown but that are familiar to a person skilled in the art are needed, these having been omitted for the sake of greater clarity in the illustration. In a realization in digital circuit technology, for example, A/D converters are also required in order to convert the weighting functions k(t) and 1-k(t) into digital functions.

Figure 3:
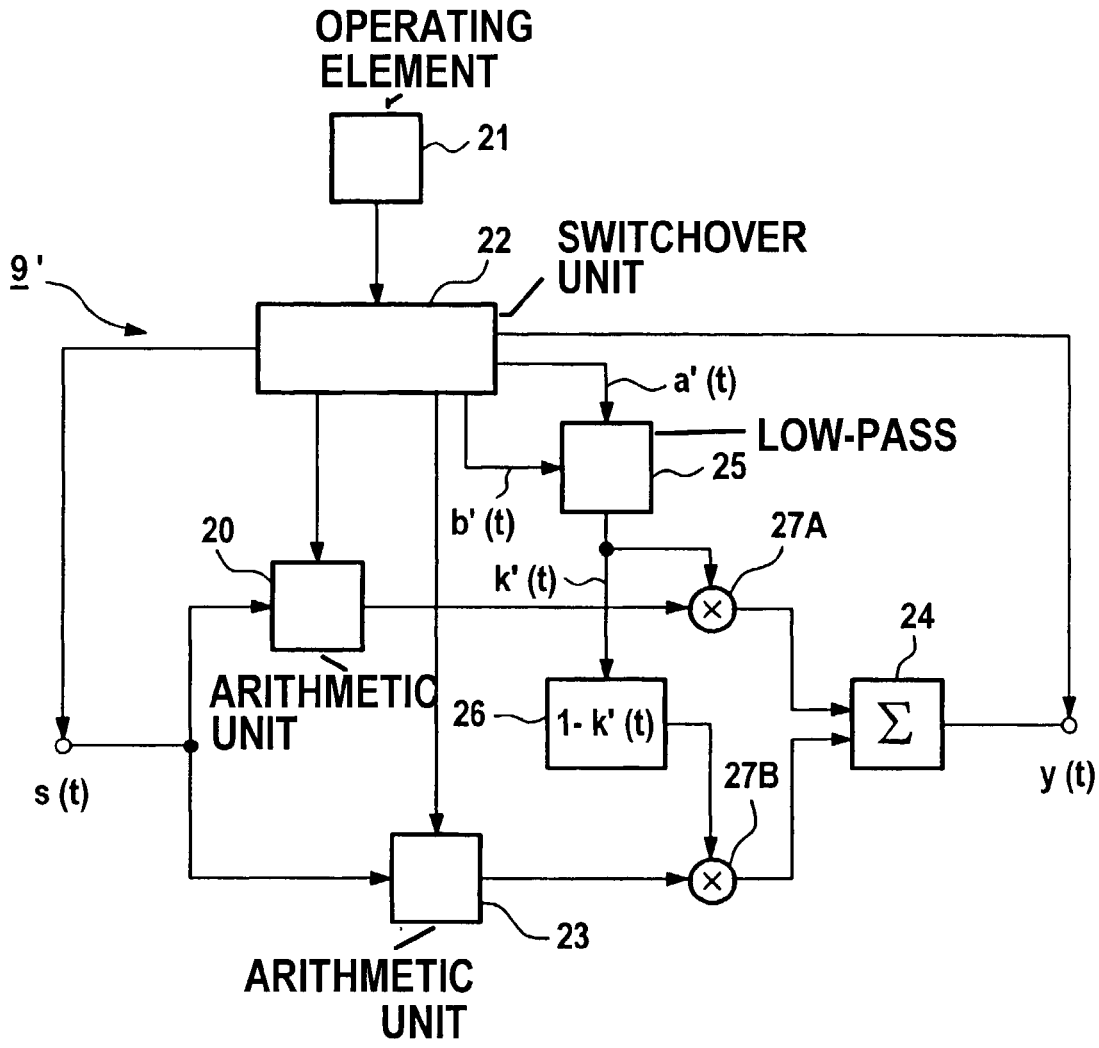
FIG. 3 is a block circuit diagram of a circuit unit for sliding switching between two hearing programs.

FIG. 3 shows another exemplary embodiment of the invention. In this embodiment, too, a signal processing is realized in a signal path of a hearing aid with a circuit unit 9'; namely, a processing of the input signal s(t) that is adapted to a specific ambient situation ensues with an arithmetic unit 20. The signal processing in the arithmetic unit 20 is determined by a parameter set, the "hearing program 1" in the exemplary embodiment.

First, let the output of the arithmetic unit 20 be identical with the output signal of the circuit unit 9', namely y(t). By actuating an operating element 21, a switch is now made to the "hearing program 2". The circuit unit 9' comprises a switchover unit 22 for implementing the switching event. This initially causes a parallel signal processing to ensue for the duration of the switchover event in the signal path of the hearing aid at least for a part of the signal path, namely between the signal input s(t) and the signal output y(t) in which the parameters of the signal processing of the two hearing programs differ.

Taking the parameter set that determines the hearing program 2 in to consideration, a processing of the input signal s(t) also ensues in an arithmetic unit 23. In order to assure a sliding transition between the two hearing programs, the outputs of the arithmetic units 20 or 23 are weighted and supplied to a summer 24. In this exemplary embodiment also, the weighting ensues by a signal a'(t) that jumps from the value 1 to the value 0. An output signal k'(t) of the low-pass 25 is generated that decreases steadily from 1 to 0 within a specific time duration via a low-pass 25 whose time constant can be controlled by the switchover unit 22 via the signal b'(t).

For different weighting of the outputs of the arithmetic units 20 and 23, the signal k'(t) as well as the signal 1-k'(t) formed in the arithmetic unit are supplied to a multiplier 27A or 27B. A sliding transition from a hearing program 1 to a hearing program 2 is realized with this exemplary embodiment, where the duration of the switchover event is controllable by the switchover unit 22 via a function b'(t).

In addition to the manual switching with the operating element 21, the switchover event between two hearing programs can also be automatically triggered. Furthermore, the invention on the basis of the example of a switchover event between two hearing programs can also be analogously expanded to more than two programs between which switches are implemented.

When a classifier cannot clearly recognize the momentary auditory situation, then this switches between different auditory situations very frequently and at short time intervals. Advantageously, a plurality of hearing programs are then automatically operated in parallel in the hearing aid over a longer time span. When, for example, the situation recognition ensues with a circuit arrangement comparable to the classifier 11 according to FIG. 1, then the weight of the respective auditory situation is approximately proportional on average to the time duration for which the respective auditory situation has been found.

Analogously, the exemplary embodiment shown on the basis of the switchover event between two hearing programs can be transferred to other arbitrary switching events in the hearing aid in which jumps between parameters that influence the signal processing previously occurred.

Figure 4:
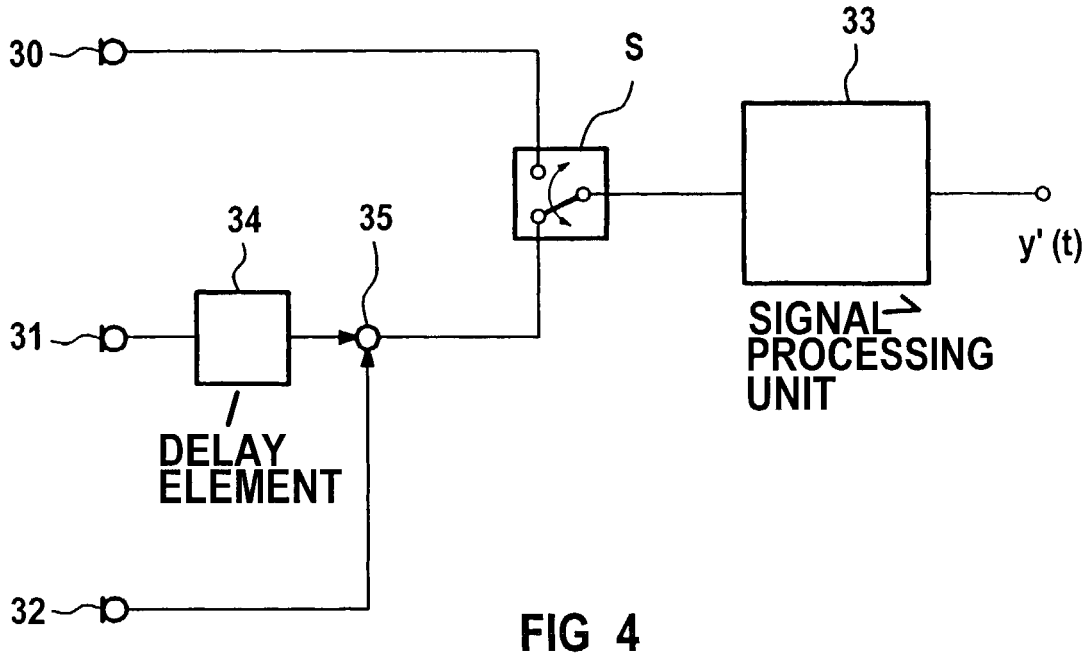
FIG 4 PRIOR ART
FIG. 4 is a block circuit diagram of a signal input of a hearing aid of the Prior Art that can be switched between omnidirectional and directional reception.
Figure 5:
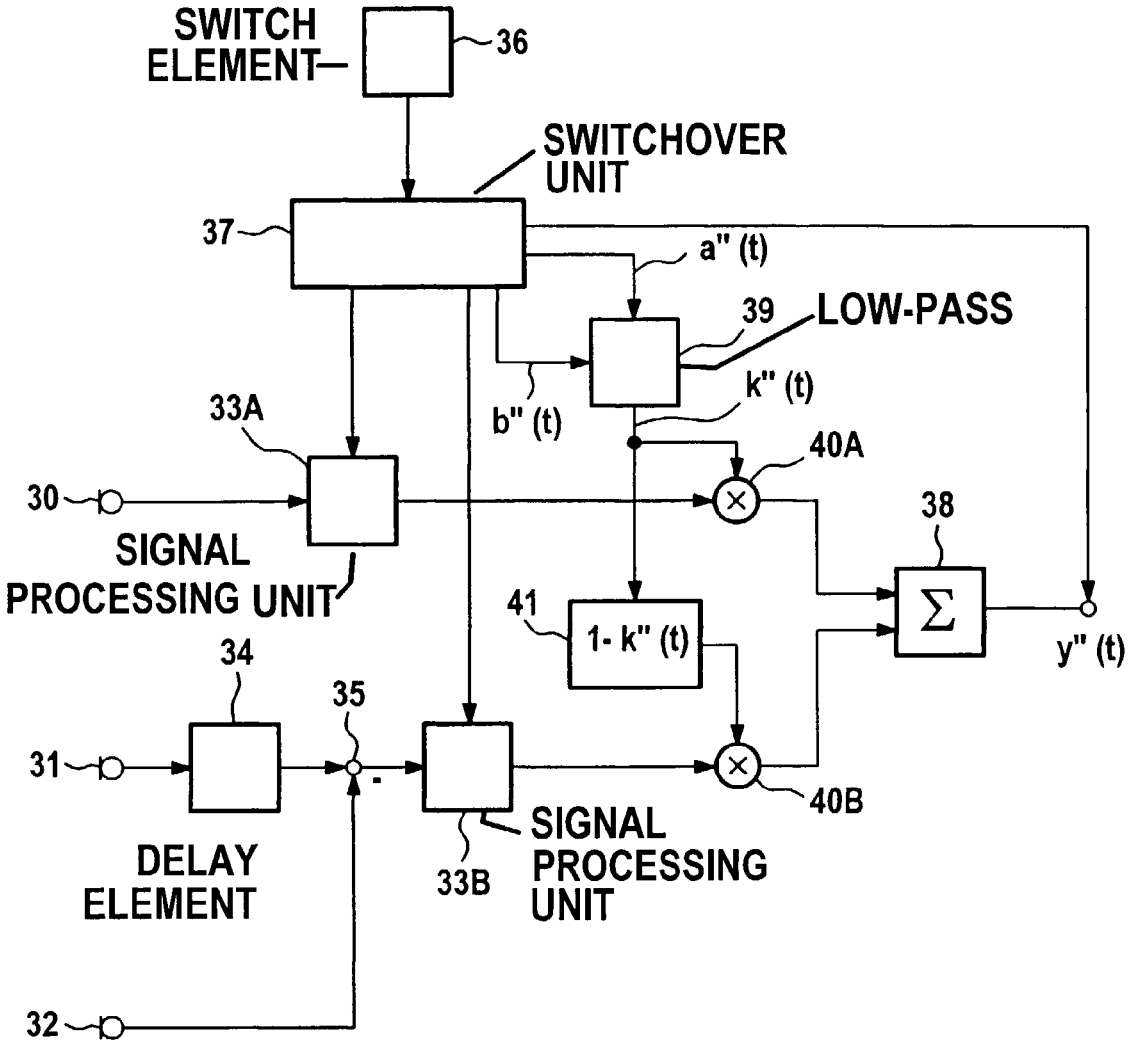
FIG. 5 is a block circuit diagram of a circuit arrangement that effects a sliding transition between omnidirectional and directional reception.

Just as in the case of the application of algorithms that implement a signal processing in the hearing aid, the invention can also be applied given various functions of a hearing aid that can be activated, deactivated of modified in terms of their setting. FIG. 4 shows an example of this. Different microphone reception characteristics can be set by a microphone arrangement having the microphones 30, 31 and 32. When a switch S is in a first switch position, then only the omnidirectional microphone 30 is connected to a signal processing unit 33. A directional microphone 31, 32 is realized by the electrical interconnection of the two omnidirectional microphones 31 and 32 with a delay element 34 and a difference element 35. When the switch S is in the second switch position shown in FIG. 4, then the directional microphone 31, 32 is connected to the signal processing unit 33. Such a switchable microphone system is known from the Prior Art. When throwing the switch S, noises caused by the switching as well as unnatural sound modifications can arise in the signal transmission with the hearing aid. In order to avoid these, a circuit arrangement as shown in the block circuit diagram of FIG. 5 is provided for the signal input. There is also the possibility of selecting between an omnidirectional reception with the microphone 30 and a direction reception with the microphones 31 and 32 in conjunction with the delay element 34 and the difference element 35. At least during the switchover event, the output of the omnidirectional microphone 30 is supplied to a processing unit 33A, and the output of the microphone system 31, 32 is supplied to a signal processing unit 33B. The trigger for the switchover event is the switch element 36 in the exemplary embodiment. The switchover event can be triggered both manually, for example by actuating an operating element, or automatically, for example in combination with the change of the hearing program. In this exemplary embodiment, the automatic switchover event is also controlled by a switchover unit 37. This determines which parts of the signal processing are to be implemented in parallel during the switchover event and, potentially, at what location y"(t) in the signal path of the hearing aid a common signal processing can ensue. In the exemplary embodiment, the two differently weighted signal paths can be merged in the summer 38 and be subjected to a final amplification in common.

The hanging weighting of the parallel microphone signal paths in this exemplary embodiment also ensues by use of a binary signal a"(t) that changes when switching over from an omnidirectional reception with the microphone 30 to a direction al reception with the microphone system 31, 32. A low-pass 39, whose time constant is controllable by a signal b"(t) emanating from the switchover unit 37, outputs a signal k"(t) that steadily drops from 1 to 0 in the exemplary embodiment and serves as one of the input signals of a multiplier 40A. The signal 1-k"(t) formed in an arithmetic unit 41 is supplied to an input of a multiplier 40B. A signal deriving from the microphone 30 is present at the second input of the multiplier 40A; a signal deriving from the microphones 31 and 32 interconnected to one another is present at the second input of the multiplier 40B.

The circuit according to the block circuit diagram allows a soft and sliding switching between an omnidirectional and a directional microphone reception. In this embodiment, too, it is possible that both microphone characteristics are present in parallel in the hearing aid over a longer time span as a result of a very frequent switching at short time intervals by the switch element 36, for example, produced by an auditory situation that cannot be clearly defined.

Figure 6:
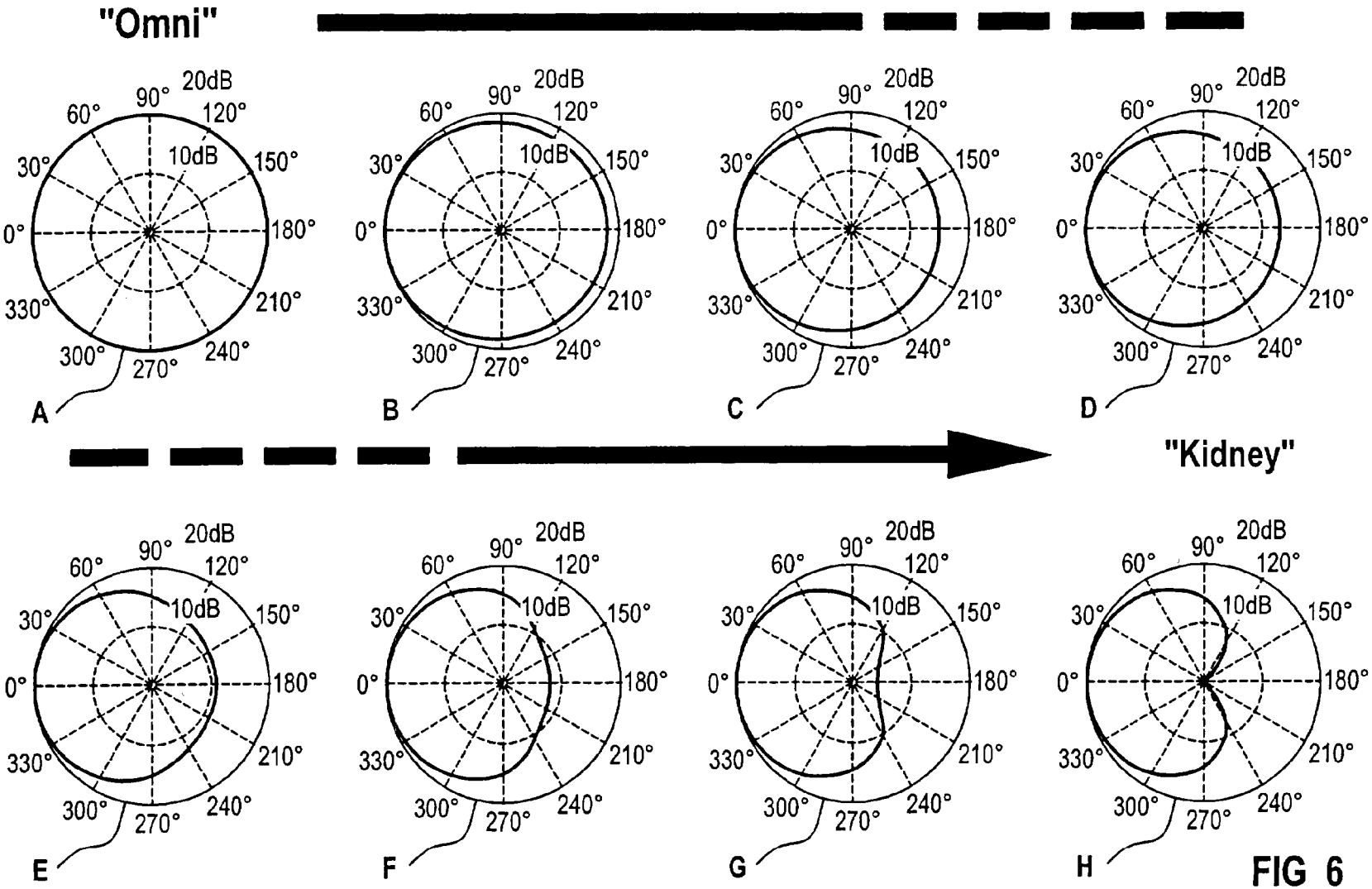
FIG. 6 are graphs illustrating the modification of the directional characteristic given the soft transition between omnidirectional and directional operation on the basis of directional diagrams.

The soft, sliding transition between omnidirectional and directional microphone reception is additionally graphically illustrated by the directional diagrams A through H according to FIG. 6. What these show is the transition proceeding from the first operating condition in which only an omnidirectional reception ensues (directional characteristic A). The diagrams B through G then show the transition for which both operating conditions are present parallel in the hearing aid, i.e., a respective input signal is picked up and further-processed both from the omnidirectional microphone as well as from the directional microphone. As a result of the weighting of the processed and summed microphone signals that varies over time, the directional characteristics b through g arise. At the conclusion of the switchover event, finally, only the second operating condition is still present in the hearing aid, and the directional characteristic comprises the kidney shape illustrated in FIG. 6H.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

| | |
|---|---|
| 1 | hearing aid |
| 2, 3, 4, 30, 31, 32 | microphone |
| 5, 34 | delay element |
| 6, 35 | difference element |
| 7, 33, 33A, 33B | signal processing unit |
| 8 | telephone coil |
| 9, 9' | circuit unit for reducing noise signals |
| 10 | earphone |
| 11 | classifier |
| 11A | analysis unit |
| 11B, 25, 39 | low-pass |
| 12, 20, 23 | arithmetic unit |
| 13A, 13B, 27A, 27B, 40A, 40B | multiplier |
| 14, 26, 41 | arithmetic unit |
| 15, 24, 38 | summer |
| 21 | operating element |
| 22, 37 | switchover unit |
| S | switch |
| a(t), a'(t), a"(t), b(t), b"(t), k(t), k'(t), k"(t), s(t0, y(t), y'(t), y"(t) | signals |

What is claimed is:

1. A method for operating a hearing aid, comprising:

picking up an input signal with an input transducer of the hearing aid;

converting the input signal into an electrical signal;

processing and amplifying the electrical signal;

outputting the processed and amplified electrical signal with an output transducer; and initiating a switch-over process to slidably transition the hearing aid from a first operating condition into a second operating condition;

wherein the switch-over process comprises:

splitting a signal path within the hearing aid device between a signal input at which an input signal is present and a signal output at which an output signal is present into a first signal path and a parallel second signal path;

traversing both signal paths by the input signal only during the switch-over process, wherein the first operating condition implemented by an algorithm of a digital signal processor (DSP) having at least one variable parameter exists in the first signal path and the second operating condition implemented by an algorithm of a DSP or by the algorithm of the DSP exists in the second signal path in the hearing device;

linking a first signal that results from the first operating condition and a second signal that results from the second operating condition with one another via a weighting function; and reducing the weighting of the first signal and increasing the weighting of the second signal.

2. The method according to claim 1 further comprising:

switching on an algorithm for signal processing in the first operating condition; and switching off the algorithm for signal processing in the second operating condition.

3. The method according to claim 2, wherein the algorithm relates to an aspect selected from the group consisting of a frequency response, a reduction of noise signals, a boost of voice signals, a directional microphone characteristic, and a compression.

4. The method according to claim 1, further comprising:

switching off an algorithm for signal processing in the first operating condition; and switching on the algorithm for signal processing in the second operating condition.

5. The method according to claim 4, wherein the algorithm relates to an aspect selected from the group consisting of a frequency response, a reduction of noise signals, a boost of voice signals, a directional microphone characteristic, and a compression.

6. The method according to claim 1, wherein the algorithm relates to an aspect selected from the group consisting of a frequency response, a reduction of noise signals, a boost of voice signals, a directional microphone characteristic, and a compression.

7. The method according to claim 1, further comprising:

activating a function of the hearing aid in the first operation condition; and not activating the function of the hearing aid in the second operation condition.

8. The method according to claim 7, wherein the function relates to an attribute selected from the group consisting of a microphone characteristic, a reception of an input signal with telephone coil, and a generation of a signal for tinnitus therapy.

9. The method according to claim 1, further comprising:

activating a function of the hearing aid in the second operating condition; and not activating the function of the hearing aid in the first operating condition.

10. The method according to claim 9, wherein the function relates to an attribute selected from the group consisting of a microphone characteristic, a reception of an input signal with telephone coil, and a generation of a signal for tinnitus therapy.

11. The method according to claim 1, further comprising modifying an activated function of the hearing aid in the second operating condition compared to the first operating condition.

12. The method according to claim 11, wherein the function relates to an attribute selected from the group consisting of a microphone characteristic, a reception of an input signal with telephone coil, and a generation of a signal for tinnitus therapy.

13. The method according to claim 1, further comprising:

setting parameters for controlling the signal processing at the hearing aid, wherein at least one of the parameters in the second operating condition exhibits a modified value compared to a value of the parameter in the first operating condition.

14. The method according to claim 1, further comprising, during the switch-over process:

decreasing a weight of a first parameter; and decreasing a weight of a second parameter.

15. The method according to claim 14, wherein a sum of the weights amounts to one.

16. The method according to claim 14, further comprising:

controlling the switch-over process by a switchover algorithm.

17. The method according to claim 1, further comprising: manually triggering the switch-over process.

18. The method according to claim 1, further comprising: automatically triggering the switch-over process.

19. The method according to claim 1, further, comprising: setting a duration of the switching-over process.

20. The method according to claim 19, further comprising:

activating a function of the hearing aid in the first operating condition; and not activating the function of the hearing aid in the second operating condition.

21. The method according to claim 20, wherein the function relates to an attribute selected from the group consisting of a microphone characteristic, a reception of an input signal with telephone coil, and a generation of a signal for tinnitus therapy.

22. The method according to claim 19, further comprising:

activating a function of the hearing aid in the second operating condition; and not activating the function of the hearing aid in the first operating condition.

23. The method according to claim 22, wherein the function relates to an attribute selected from the group consisting of a microphone characteristic, a reception of an input signal with telephone coil, and a generation of a signal for tinnitus therapy.

24. The method according to claim 19, further comprising modifying an activated function of the hearing aid in the second operating condition compared to the first operating condition.

25. The method according to claim 24, wherein the function relates to an attribute selected from the group consisting of a microphone characteristic, a reception of an input signal with telephone coil, and a generation of a signal for tinnitus therapy.

26. The method according to claim 19, further comprising:

setting parameters for controlling the signal processing at the hearing aid, wherein at least one of the parameters in the second operating condition exhibits a modified value compared to a value of the parameter in the first operating condition.

27. The method according to claim 19, further comprising, during the switch-over process:

decreasing a weight of a first parameter; and decreasing a weight of a second parameter.

28. The method according to claim 27, wherein a sum of the weights amounts to one.

29. The method according to claim 27, further comprising:

controlling the switch-over process by a switchover algorithm.

30. The method according to claim 19, further comprising:

manually triggering the switch-over process.

31. The method according to claim 19, further comprising:

automatically triggering the switch-over process.

32. A hearing aid, comprising:

an input transducer configured to pick-up an input signal and to convert it into an electrical signal;

a signal processing unit configured to process and amplify the electrical signal;

a signal input at which an input signal is present;

a signal output at which an output signal is present;

a sub-region between the signal input and signal in which a signal path within the hearing aid device is split into a first signal path and a parallel second signal path, a first operating condition existing in the first signal path, and a second operating condition existing in the second signal path, the first signal path having a resultant first signal from the first operating condition with a weighting, and the second signal path having a resultant second signal from the second operating condition with a weighting;

a switch-over process for slidably transitioning between the first operating condition implemented by an algorithm of a digital signal processor (DSP) having at least one variable parameter and the second operating condition implemented by an algorithm of a DSP or by the algorithm of the DSP, a parallel processing of the first operating condition and second operating condition occurring only during the switch-over Process, wherein during operation of the switch-over process, the weighting of the resultant first signal decreases and the weighting of the resultant second signal decreases;

an output transducer, configured to output a processed and amplified signal.

33. The hearing aid according to claim 32, further comprising an adjustment mechanism for a duration of the switch-over process.

34. The hearing aid according to claim 33, configured such that, during the switch-over process, a weight of a signal from the first operating condition decreases beginning with one and a weight of the signal from the second operating condition increases beginning with zero, wherein the sum of the weights amounts to one.

* * * * *